US005496486A

United States Patent [19]

Staley

[11] Patent Number: 5,496,486

[45] Date of Patent: Mar. 5, 1996

[54] PROCESS FOR INCREASING LIQUID SURFACTANT LOADING IN FREE FLOWING POWDER DETERGENTS

[75] Inventor: David S. Staley, Rockford, Mich.

[73] Assignee: Amway Corporation, Ada, Mich.

[21] Appl. No.: 269,371

[22] Filed: Jun. 30, 1994

[51] Int. Cl.[6] ..... C11D 11/00; C11D 17/06; C11D 3/12

[52] U.S. Cl. ..... 252/89.1; 252/135; 252/525; 252/528; 252/544; 252/547; 252/174; 252/174.14; 252/174.17; 252/174.21; 252/174.25

[58] Field of Search ..... 252/89.1, 90, 135, 252/544, 174, 174.17, 547, 174.21, 174.22, 525.528, 174.14, 174.25, DIG. 11

[56] References Cited

U.S. PATENT DOCUMENTS

| | | | |
|---|---|---|---|
| 2,480,730 | 8/1949 | Hafford et al. | 252/138 |
| 2,874,123 | 2/1959 | Schaafsma et al. | 252/99 |
| 3,726,813 | 4/1973 | Borrello | 252/539 |
| 3,749,675 | 7/1973 | Chang | 252/135 |
| 3,764,541 | 10/1973 | Kaneko | 252/89 |
| 3,769,222 | 10/1973 | Yuko et al. | 252/89 |
| 3,868,336 | 2/1975 | Mazzola et al. | 252/527 |
| 3,996,149 | 12/1976 | Burke, Jr. | 252/160 |
| 4,107,067 | 8/1978 | Murphy et al. | 252/135 |
| 4,115,308 | 9/1978 | Guerry | 252/135 |
| 4,162,994 | 7/1979 | Kowalchuk | 252/532 |
| 4,239,659 | 12/1980 | Murphy | 252/524 |
| 4,259,217 | 3/1981 | Murphy | 252/547 |
| 4,279,766 | 7/1981 | Joubert et al. | 252/174.25 |
| 4,321,157 | 3/1982 | Harris et al. | 252/174.25 |
| 4,347,168 | 8/1982 | Murphy et al. | 252/547 |
| 4,352,678 | 10/1982 | Jones et al. | 252/140 |
| 4,379,080 | 4/1983 | Murphy | 252/526 |
| 4,427,417 | 1/1984 | Porasik | 23/313 R |
| 4,444,674 | 4/1984 | Gray | 252/95 |
| 4,473,485 | 9/1984 | Greene | 252/174.12 |
| 4,474,683 | 10/1984 | Story et al. | 252/369 |
| 4,487,710 | 12/1984 | Kaminsky | 2562/546 |
| 4,515,707 | 5/1985 | Brooks | 252/174 |
| 4,534,879 | 8/1985 | Iding et al. | 252/174 |
| 4,675,124 | 6/1987 | Seiter et al. | 252/91 |
| 4,726,908 | 2/1988 | Kruse et al. | 252/91 |
| 4,869,843 | 9/1989 | Saito et al. | 252/135 |

FOREIGN PATENT DOCUMENTS

| | | |
|---|---|---|
| 0513824 | 11/1992 | European Pat. Off. . |
| 560395A1 | 9/1993 | European Pat. Off. . |
| 57-091732 | 6/1982 | Japan . |
| 61-118500 | 6/1986 | Japan . |
| 5202399 | 8/1993 | Japan . |
| 2171414 | 8/1986 | United Kingdom . |

OTHER PUBLICATIONS

Jenike, A. W., "Storage and Flow of Solids", *Bulletin of the University of Utah,* vol. 53, No. 26, pp. 766–781, Nov. 1964.

Johanson, J. R., "The Johanson Indicizer™ System vs. the Jenike Shear Tester", *Bulk Solids Handling,* vol. 12, No. 2, pp. 237–240, May 1992.

*Primary Examiner*—Paul Lieberman
*Assistant Examiner*—Lorna M. Douyon
*Attorney, Agent, or Firm*—Price, Heneveld, Cooper, DeWitt & Litton

[57] ABSTRACT

A method for producing a granular, powdered detergent comprising combining a first portion of a flowable powder detergent builder with a liquid surfactant, followed by addition of an effective amount of a finely divided barrier particle material to the first portion of builder and liquid surfactant. The resulting blend is then combined with a second portion of flowable powder detergent builder, such that the first portion of detergent builder comprises from about 10% to about 90% of the total amount of detergent builder in the resulting composition.

16 Claims, 3 Drawing Sheets

PROCESS FOR INCREASING LIQUID SURFACTANT LOADING IN FREE FLOWING POWDER DETERGENTS

BACKGROUND OF THE INVENTION

The present invention relates to a free flowing detergent composition having a relatively high concentration of surfactant. More particularly, the present invention provides a free flowing detergent composition having a high concentration of a "low wash temperature" surfactant, which as used herein refers to a surfactant having relatively low melting and pour points.

There is a trend in the consumer products industry to use smaller packaging and container sizes. Reduced sizes conserve materials such as paper, cardboard, and plastic and are "environmentally friendly." This consumer preference trend for reduced package sizes, now occurring in the detergent industry, necessitates that more concentrated, higher bulk density detergent compositions be formulated. In order to formulate a concentrated detergent, it is necessary to utilize relatively high levels of surfactant to achieve comparable washing efficacy to a larger amount of a less concentrated, bulkier detergent composition. Moreover, it is desirable to employ relatively high levels of surfactants in detergent compositions as such increased concentrations generally improve the cleansing action of the detergent composition. However, such high surfactant loadings in granules or powdered detergents made according to prior art methods generally reduce the flowability of such detergents. Reduced flowability tends to decrease density by reducing optimal particle packing. Thus, a need exists for a detergent composition which has a relatively high concentration of surfactant and which has good flowability.

The consumer and the automatic washing appliance industry have moved toward employing colder wash temperatures as a means to obtain more energy efficient appliances and reduce operating costs. Such lower temperature washing necessitates the use of surfactants having lower melting points, pour points and viscosities than surfactants utilized previously. When incorporated in granular or powdered detergent compositions, such low wash temperature surfactants tend to detract from the flowability of the detergent composition more so than higher wash temperature, more viscous surfactants. Thus, there is a need for a detergent composition which utilizes the low wash temperature surfactants and which has good flowability. It would be especially desirable to provide a detergent composition which had a relatively high concentration of low wash temperature surfactants.

Prior artisans have attempted to formulate granular or powdered detergent compositions having relatively high surfactant concentrations as in U.S. Pat. No. 3,769,222 to Yurko et al. However, known prior art compositions with relatively high surfactant concentrations have limited flowability or achieve acceptable flowability by using more viscous, high wash temperature surfactants and/or undesirably high silica content (5–25% for Yurko et al.), which has low detergent functionality. Thus, there is a need for a method of formulating a detergent composition which has both a high level of low viscosity surfactant and a high flowability of the resulting powder.

Most granular detergents are presently produced by spray drying. This process involves slurrying of detergent components and spray atomization in a high temperature air stream. To minimize volatilization of nonionic surfactants in the spray tower, the detergent industry has focused its efforts on post-dosing. In post-dosing, one or more surfactants are added to the product after the spray drying operation. Usually, this method works well only for surfactants that are normally solid at the processing temperature. This practice limits the use of the low wash temperature surfactants (which are liquid at the processing temperature) whose inclusion is more desirable in some detergent compositions. Post-dosing of spray dried base material with low wash temperature surfactants, in amounts sufficient to provide satisfactory wash performance, generally results in poor flowing, aesthetically displeasing products. Moreover, the amount of low wash temperature surfactant that may be employed in the detergent formulation is severely limited. This limitation is undesirable, since, for heavy duty laundry detergents and particularly concentrated detergent compositions, it is advantageous to have large amounts or relatively high concentrations of surfactant present.

SUMMARY OF THE INVENTION

The present invention is a powdered detergent composition and method for producing comprising providing a first portion of a flowable powder detergent builder, blending the builder with a liquid surfactant, and adding an effective amount of finely divided barrier material to the blend to form a first component. A second portion of a flowable powder detergent builder is combined with the first component such that the first portion of detergent builder comprises between about 10% to about 90% of the combined total of the first and second portions of detergent builder.

DESCRIPTION OF THE PREFERRED EMBODIMENTS

Figure 1:
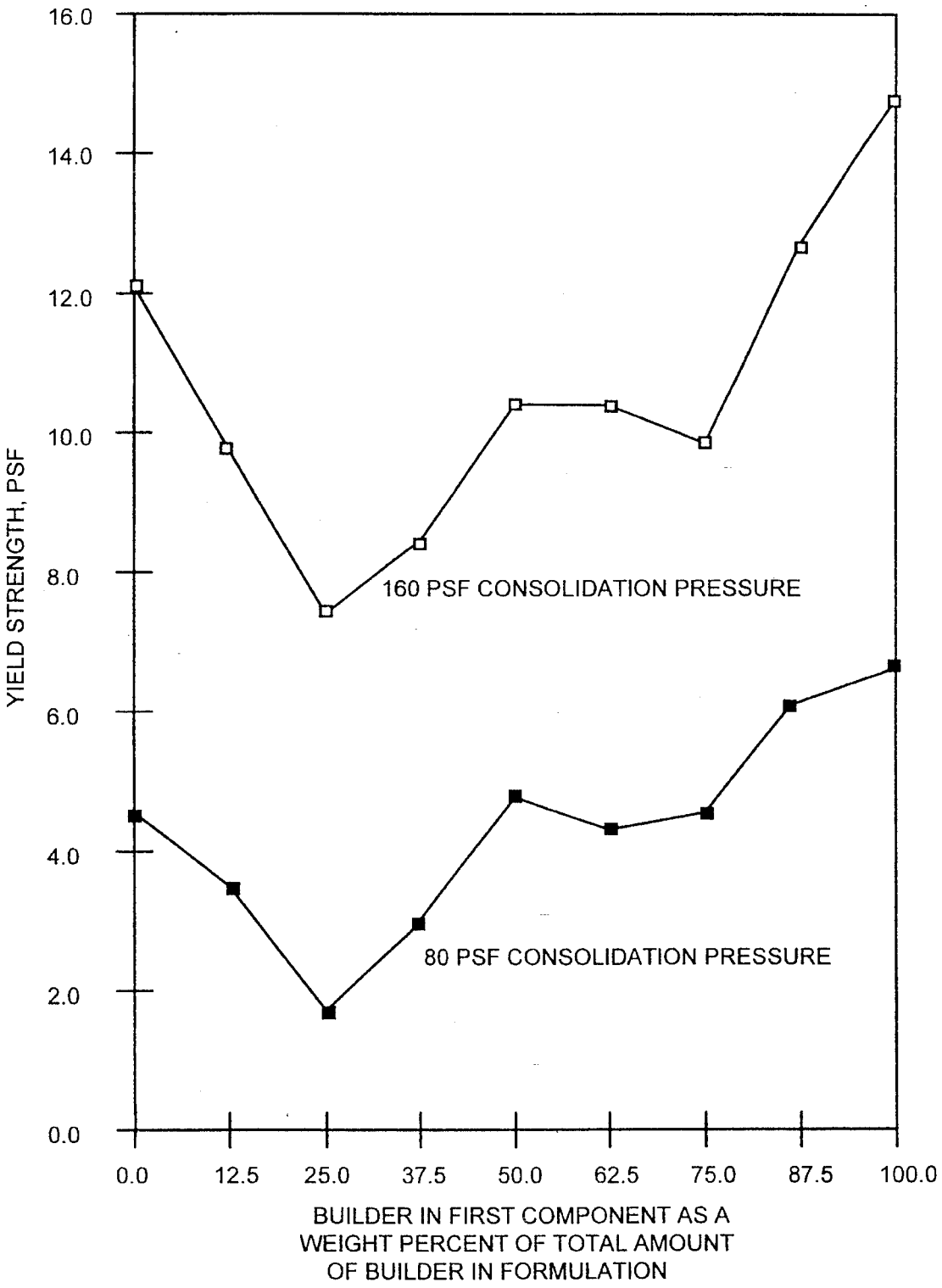
FIG. 1 graphs yield strength versus proportion of detergent builder in the first component of the composition of the present invention as listed and detailed in Table 1.

In the preferred embodiment, the powdered detergent composition is a blend of a first component and a second component as follows. The first component preferably comprises a portion of the flowable powder detergent builder, substantially all of the liquid surfactant, and substantially all of the finely divided barrier particles. The first component is formed by combining a portion of the flowable powder detergent builder with the liquid surfactant. Then an effective amount of finely divided barrier particles are combined with the first component. The dry detergent composition of the present invention is then obtained upon blending the first component with preferably, the remaining portion of the flowable powder detergent builder, which constitutes the second component.

The total builder content, based upon the builder, barrier and surfactant components combined, is from about 40% to about 95% (all percentages expressed herein are percentages by weight). The portion of the flowable powder detergent builder which is incorporated in the first component, ranges from about 10% to about 90% based upon the total weight of the flowable powder detergent builder utilized in the detergent composition. It is preferred to utilize at least 25% of flowable powder detergent builder in the first component. Detergent compositions made in accordance with the preferred embodiment may utilize the same type of builder in both the first and second components. Alternatively, detergent compositions may employ different types of builders in the first and second components, or utilize different combinations of builders in varying proportions in each of the first and second components.

Examples of suitable flowable powder detergent builders for use in the present invention include, but are not limited to various detergent grades of sodium carbonate such as light ash, dense ash, and needle ash. Additional examples of flowable powder builders include various forms of sodium aluminum silicate (zeolites), pentasodium triphosphate (also known as sodium tripolyphosphate), trisodium nitrilotriacetate (NTA), citrates, sulfates, and mixtures of any of the foregoing. The preferred builder for use in the present invention is sodium carbonate. The most preferred sodium carbonate builder is light ash or light soda ash.

The average particle size of the flowable powder detergent builder for use in the present invention may be nearly any detergent compatible particle size. Thus, it is envisaged that a broad range of particle sizes may be utilized depending upon the particular end use requirements of the particular composition. However, a typical range for the average particle size of the flowable powder detergent builder is from about 1 micron to about 600 microns. The mean particle size of the preferred builder, sodium carbonate, is from about 40 microns to about 600 microns. The mean particle size of the most preferred sodium carbonate builder, light ash, is from about 40 microns to about 150 microns.

Generally, nearly any liquid or semi-liquid surfactant may be used in the present invention. By "liquid," it is meant that the surfactant is in a liquid state at the range of temperatures which the detergent composition will be processed, stored, or utilized. Typically, such temperatures are from about 0° C. to about 65° C. Thus, the liquid or semi-liquid surfactant should have a melting point below about 65° C. It is preferred to utilize a surfactant having a melting point and pour point above about 5° C. and below about 30° C. Clearly, it is envisaged that the surfactant may be slightly heated to drive it to a liquid state to improve its flowability for ease of handling in practicing the methods of the present invention. Moreover, combinations of various types of surfactants may be utilized. Suitable surfactants for use in the present invention include anionic surfactants, cationic surfactants, nonionic surfactants, amphoteric surfactants, and mixtures thereof. The preferred surfactant for use in the present invention is a nonionic surfactant or mixture of nonionic surfactants. The amount of surfactant incorporated in the first component should be an amount such that the amount of surfactant in the three components combined, i.e. builder, surfactant, and carrier, is from about 5% to about 50%. Although it is preferred to incorporate all or substantially all of the liquid surfactant in the first component, it is envisaged that a portion of the surfactant could be employed in the second component. The amount of surfactant in the resulting detergent composition should be determined according to the particular end use requirements of the detergent composition.

Examples of the nonionic surfactants which may be utilized in the present invention include, but are not limited to polyethylene oxide condensates of alcohol phenols and condensation products of primary or secondary aliphatic alcohols. Representative examples of the nonionic surfactant(s) which may be utilized in the present invention include, but are not limited to linear primary alcohol ethoxylates, e.g. a mixture of $C_{12}$-$C_{15}$ alcohol ethoxylates with an average of 7 moles of ethylene oxide per mole of alcohol, a mixture of $C_{10}$-$C_{16}$ alcohol ethoxylates, a mixture of $C_{14}$-$C_{15}$ alcohol ethoxylates with an average of 12 moles of ethylene oxide per mole of alcohol, an alkylphenol ethoxylate, and combinations thereof. Additional examples of nonionic surfactant(s) for use in the present invention include, but are not limited to amides such as alkanolamides and/or fatty amides, alkyl polyglycosides, amine oxides, alcohol alkoxylates including condensation products of fatty alcohols and ethylene and/or propylene oxide other than those previously noted, ethoxylated esters, and esters of sorbitan, glycerol, and combinations thereof. The preferred surfactant depends upon the particular end use requirements for the detergent composition made in accordance with the present invention.

Examples of cationic surfactants envisaged for use in the present invention include, but are not limited to dodecyl trihydroxyethyl ammonium salts, myristyl trihydroxyethyl ammonium salts, cetyl trihydroxyethyl ammonium salts, stearyl trihydroxyethyl ammonium salts, oleyl trihydroxyethyl ammonium salts, dodecyl dihydroxyethyl hydroxypropyl ammonium salts, dodecyl dihydroxypropyl hydroxyethyl ammonium salts, dodecyl trihydroxypropyl ammonium salts, dodecylbenzyl trihydroxyethyl ammonium salts, dodecyl dihydroxyethyl methyl ammonium salts, dodecyl dihydroxypropyl methyl ammonium salts, dodecyl dihydroxyethyl ammonium salts, myristyl dihydroxyethyl methyl ammonium salts, cetyl dihydroxyethyl methyl ammonium salts, stearyl dihydroxyethyl methyl ammonium salts, oleyldihydroxyethyl methyl ammonium salts, dodecyl hydroxyethyl hydroxypropyl methyl ammonium salts, coconutalkyl benzyl dihydroxyethyl ammonium salts, dodecylbenzyl dihydroxyethyl methyl ammonium salts, dicoconutalkyl dihydroxyethyl ammonium salts, dodecyl dimethyl hydroxyethyl ammonium salts, dodecyl dimethyl hydroxypropyl ammonium salts, myristyl dimethyl hydroxyethyl ammonium salts, dodecyl dimethyl dioxyethylenyl ammonium salts, dodecylbenzyl hydroxyethyl dimethyl ammonium salts, and coconutalkyl benzyl hydroxyethyl methyl ammonium salts.

Examples of anionic surfactants for use in the present invention include, but are not limited to alkyl aryl sulfonates, alcohol sulfates, alcohol ethoxysulfates, soaps, alcohol ether carboxylates, alkane sulfonates, and the like. Additional examples of amphoteric and anionic surfactants include those which are utilized in conventional detergent compositions.

The finely divided barrier particles may be any material which effectively isolates surfactant laden builder particles from adjacent surfactant laden particles and prevents further agglomeration or coalescence. Representative examples of suitable materials for the finely divided barrier particles include, but are not limited to hydrated amorphous silica (often referred to as synthetic precipitated silica), silicon dioxide, crystalline-free silicon dioxide (fumed silica), synthetic amorphous silicon dioxide hydrate, and mixtures of any of the foregoing. The preferred material for the finely divided barrier particle is hydrated amorphous silica.

The finely divided barrier particles should have an average particle or aggregate particle size of from about 0.5 microns to about 50 microns. Silica particles often exist in varying forms. When in a powder form, silica particles generally exist as aggregates of ultimate particles of colloidal size. Thus, particulate silica may be characterized by the size of the aggregate collection of ultimate silica particles and by the size of the ultimate particles. Typically, the average ultimate particle size for precipitated silica is from about 0.01 microns to about 0.025 microns. Average aggregate particle size of precipitated silica ranges from about 1 micron to about 10 microns. The average ultimate particle size for fumed silica is from about 0.001 microns to about 0.1 microns. The average aggregate particle size of fumed silica ranges from about 2 microns to about 3 microns.

The amount of barrier particles utilized in the first component is preferably an effective amount, that is an amount which provides a barrier between adjacent particles of the first portion of the flowable powder detergent builder loaded with surfactant. Reduced interaction with loaded builder particles promotes high flowability. Although it is preferred to incorporate all or substantially all of the finely divided barrier particles in the first component, it is envisaged that a portion of the finely divided barrier particles could be employed in the second component. Although not wishing to be bound to any particular theory, it is believed that the barrier particles serve to also isolate the blend of builder materials and liquid surfactant incorporated in the first component from the remaining portion of the material in the second component, thereby promoting the overall flowability of the resulting composition.

In the preferred embodiment, the quantity of barrier particles used is minimized, since they are considered to have minimal cleaning activity. Such minimization is surprisingly made possible by the process and product of the present invention. Thus in the preferred embodiment, the barrier material, as a percentage of builder, barrier and surfactant components combined is from about 0.5% to about 5%, more preferably no more than about 4% and most preferably no more than about 3%.

The second component preferably comprises the remaining portion of the flowable powder detergent builder which is not incorporated into the first component. It is substantially free of surfactant (not coated or impregnated with surfactant), in that it would not contain sufficient surfactant to serve as a detergent composition, and is most preferably completely free of surfactant. That remaining amount ranges from about 90% to about 10% of the total detergent builder incorporated in the composition of the present invention. Other ingredients can be added in addition to the remaining portion of builder employed in the second component.

The powdered detergent compositions of the present invention may contain a variety of other ingredients in addition to the above described first and second components. Examples of such optional ingredients include soil suspending agents, dyes, pigments, perfumes, bleaches, bleach activators, flourescers, antiseptics, germicides, enzymes, foaming depressants, anti-redeposition agents, fabric softening agents (e.g. various grades of clay), builders and zeolites. Such optional components may be added to either the first component, the second component, the resulting mixture of the first and second components, or one or more of the foregoing. Such other components may be added by spraying or otherwise contacting, attaching, adhering, blending, mixing, encapsulating, agglomerating or the like onto or with any one of the first component, second component or resulting mixture.

In making the granular, powdered detergent composition of the preferred embodiment, the first portion of flowable powder detergent builder is placed in a suitable mixing vessel and combined with the liquid or semi-liquid surfactant. Then, the finely divided barrier particles are added to the resulting mixture and blended or mixed therein. The finely divided barrier particles are added after the first portion of builder and the surfactant have been substantially combined. The resulting mixture is then combined with the remaining portion of the flowable powder detergent builder and/or other materials.

EXPERIMENTAL

In nine different formulations, the proportion of builder utilized in the first component was varied from 0% to 100% and proportion of builder utilized in the second component was varied from 100% to 0%. Each of the nine compositions listed in Table 1 below utilized 68.6% light ash distributed between the first and second particulate components, 28.6% $C_{12}$-$C_{15}$ alcohol ethoxylates with an average of 7 moles of ethylene oxide per mole of alcohol nonionic surfactant, and 2.8% precipitated silica. Thus, by holding constant the overall formulation of each composition and only varying the amount or proportion of builder which is incorporated into the first and second components, the impact upon yield strength and bulk density is clearly illustrated as in FIGS. 1 and 2.

Yield strength provides an indication of the flowability of the granular or powdered detergent composition of the present invention. Accordingly, a detergent which has relatively high flowability (and thus flows relatively easily) has a relatively low yield strength. A more dense, and thus more concentrated detergent, can be packaged in more compact packaging. Thus, it is desirable to minimize yield strength and maximize bulk density and surfactant concentration. Yield strength was determined with modified methods based upon powder flow principles originally developed by Andrew W. Jenike, "Storage and Flow of Solids", *Bulletin of the University of Utah*, Volume 53, No. 26, November 1964, and J. R. Johanson, "The Johanson Indicizer" System vs. the Jenike Shear Tester", *Bulk Solids Handling*, Volume 12, No. 2, pages 237–240, May 1992. "Yield strength" is best analogized as the force required to break a compressed cake of detergent. The test simulates the force required to induce a granular, powdered product to flow at a certain spot in a hopper experiencing a specified head pressure. It was determined for cakes compressed at 80 psi and 160 psi. It is very analogous and applicable to real world situations where flowability is of the utmost concern, i.e., in product storage and transfer equipment and in machines with automatic dispensers. Bulk density was determined by conventional methods.

TABLE 1

Yield Strength and Bulk Density vs. Proportion of Detergent Builder in First and Second Components

| Portion of Builder In First Component | Portion of Builder In Second Component | Yield Strength at 80 psf | Yield Strength at 160 psf | Compressed Bulk Density at 80 psf | Compressed Bulk Density at 160 psf | Loose Bulk Density |
|---|---|---|---|---|---|---|
| 00.0% | 100.0% | 4.6 | 12.1 | 0.77 | 0.81 | 0.65 |
| 12.5% | 87.5% | 3.4 | 9.8 | 0.77 | 0.81 | 0.66 |
| 25.0% | 75.0% | 1.8 | 7.6 | 0.78 | 0.82 | 0.66 |
| 37.5% | 62.5% | 3.1 | 8.7 | 0.78 | 0.81 | 0.65 |
| 50.0% | 50.0% | 4.8 | 10.8 | 0.77 | 0.81 | 0.68 |
| 62.5% | 37.5% | 4.3 | 10.8 | 0.75 | 0.79 | 0.66 |
| 75.0% | 25.0% | 4.7 | 9.9 | 0.72 | 0.77 | 0.64 |
| 87.5% | 12.5% | 6.4 | 12.8 | 0.71 | 0.76 | 0.60 |
| 100.0% | 0.0% | 6.9 | 14.7 | 0.71 | 0.75 | 0.59 |

Although the proportions of the flowable powder detergent builder which are incorporated into the first and second components may be varied, as described above, there are several optimal proportion ranges depending upon the desired characteristics of the resulting detergent composition. As illustrated in FIG. 1, a granular, powdered detergent sample formed in accordance with the present invention comprising 68.6% light ash, 28.6% $C_{12}$-$C_{15}$ alcohol ethoxylates with an average of 7 moles of ethylene oxide per mole of alcohol nonionic surfactant, and 2.8% precipitated silica, exhibited a minimum yield strength at a ratio of 25:75 of builder parts in the first component to builder parts in the second component. In contrast, a detergent composition of this same formulation made by the method of U.S. Pat. No. 3,769,222 to Yurko et al., in which all of the builder is impregnated with surfactant, rather than being distributed between a first component which is impregnated with the surfactant and a second component which is substantially free of surfactant, exhibited a significantly higher yield strength than formulations made according to the methods of the present invention. The samples in which 100% of builder is in the first component, (see y-axis of FIG. 1 at 100%) exhibited yield strengths of over 6 psf (lbs/ft$^2$) for the sample formed by 80 psf consolidation pressure and over 14 psf for the sample formed by 160 psf consolidation pressure. Therefore, by determining the proportions of builder in the first and second components for a particular detergent formulation which correspond to a minimum yield strength, the process can be manipulated to identify the combination of ingredient proportions which lead to optimal flowability without changing the overall formulation percentages.

Figure 2:
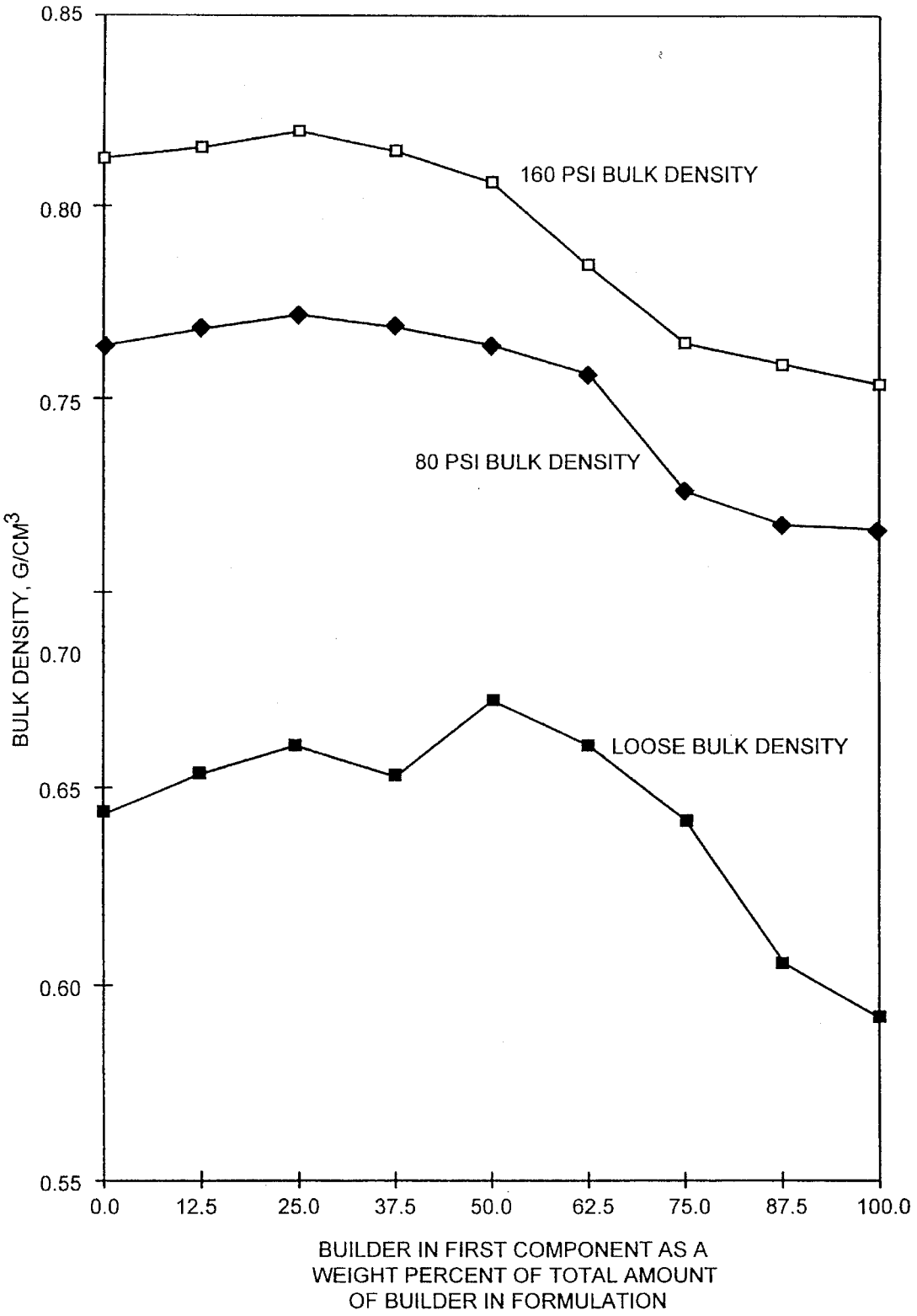
FIG. 2 graphs bulk density versus the proportion of detergent builder in the first component of the composition of the present invention as listed and detailed in Table 1.

As illustrated in FIG. 2, the present invention may also be utilized to maximize bulk density by varying the amount of builder material utilized in the first component and the amount of builder and/or other ingredients utilized in the second component. Bulk density for a detergent composition comprising 68.6% light ash, 28.6% $C_{12}$-$C_{15}$ alcohol ethoxylates with an average of 7 moles of ethylene oxide per mole of alcohol nonionic surfactant, and 2.8% precipitated silica, may be maximized by employing a ratio in the range of from about 25:75 to about 50:50 of builder parts utilized in the first and second components, respectively. As was previously noted, it is desirable to increase the bulk density of detergent compositions since such smaller volume conserves packaging materials, such as paper, cardboard or plastic. Detergent compositions made by the method of U.S. Pat. No. 3,769,222 exhibited lower bulk densities (see y-axis of FIG. 2 at 100%) than samples of the same composition made according to the methods of the present invention.

Figure 3:
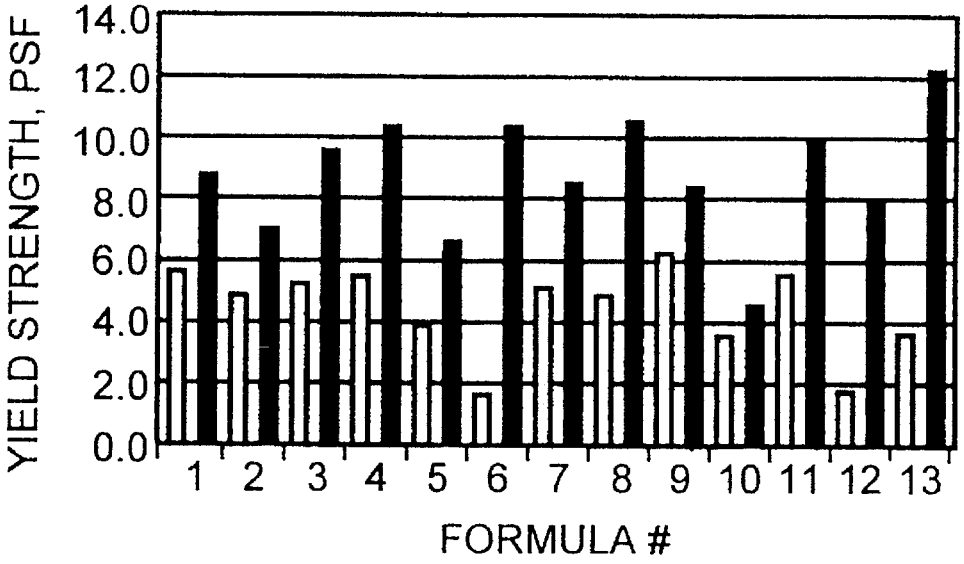
FIG. 3 graphs the yield strength of detergent formulations as listed and detailed in Table 2 and prepared in accordance with the present invention as compared to the same formulations prepared in accordance with U.S. Pat. No. 3,769,222 to Yurko et al.

In order to demonstrate the effect of ingredient selection upon yield strength and bulk density of detergent compositions prepared in accordance with the present invention, the inventor utilized various combinations of builder materials in the first and second components, surfactant materials and barrier materials in 13 different detergent compositions, listed below in Table 2. As illustrated in FIG. 3, each of those 13 different formulations made in accordance with the present invention (designated by unshaded lines) had lower yield strength and, in most instances, greater bulk density than the same composition (utilizing the same materials or compounds) as made by the prior art method (designated by dark shaded lines) in which the amount of builder is not distributed between a first and a second component. Clearly, the foregoing comparative tests demonstrate that the methods of the present invention provide a superior alternative.

TABLE 2

Yield Strength and Bulk Density of Various Detergent Compositions Made by Yurko et al. Method and Method of Present Invention

| | Percent Builder In First Component | Percent Surfactant | Percent Barrier Particles | Percent Builder In Second Component | Yield Strength at 80 psf | Yield Strength at 160 psf | Compressed Bulk Density at 80 psf | Compressed Bulk Density at 160 psf | Loose Bulk Density |
|---|---|---|---|---|---|---|---|---|---|
| Formula #1 | | | | | | | | | |
| Sample $A_1$ | 17.0 | 29.0 | 2.9 | 51.1 | 5.8 | 13.0 | 0.77 | 0.81 | 0.60 |

TABLE 2-continued

Yield Strength and Bulk Density of Various Detergent Compositions Made by Yurko et al. Method and Method of Present Invention

| | Percent Builder In First Component | Percent Surfactant | Percent Barrier Particles | Percent Builder In Second Component | Yield Strength at 80 psf | Yield Strength at 160 psf | Compressed Bulk Density at 80 psf | Compressed Bulk Density at 160 psf | Loose Bulk Density |
|---|---|---|---|---|---|---|---|---|---|
| Sample $B_1$ Formula #2 | 68.1 | 29.0 | 2.9 | | 9.1 | 16.1 | 0.70 | 0.75 | 0.51 |
| Sample $A_2$ | 47.1/0.00 | 22.5 | 2.2 | 28.2 | 5.0 | 11.3 | 0.80 | 0.85 | 0.62 |
| Sample $B_2$ Formula #3 | 47.1/28.2 | 22.5 | 2.2 | | 7.1 | 15.0 | 0.79 | 0.84 | 0.60 |
| Sample $A_3$ | 44.7/0.00 | 26.0 | 2.6 | 26.7 | 5.6 | 12.2 | 0.78 | 0.83 | 0.67 |
| Sample $B_3$ Formula #4 | 44.7/26.7 | 26.0 | 2.6 | | 9.7 | 18.9 | 0.75 | 0.81 | 0.63 |
| Sample $A_4$ | 15.5 | 34.5 | 3.4 | 46.6 | 5.9 | 21.7 | 0.72 | 0.71 | 0.60 |
| Sample $B_4$ Formula #5 | 62.1 | 34.5 | 3.4 | | 10.6 | 24.2 | 0.68 | 0.72 | 0.57 |
| Sample $A_5$ | 44.7 | 26.0 | 2.6 | 26.7 | 4.1 | 10.8 | 0.67 | 0.71 | 0.58 |
| Sample $B_5$ Formula #6 | 71.4 | 26.0 | 2.6 | | 6.9 | 15.3 | 0.66 | 0.71 | 0.59 |
| Sample $A_6$ | 17.1 | 27.4 | 4.1 | 51.4 | 1.7 | 5.2 | 0.78 | 0.79 | 0.68 |
| Sample $B_6$ Formula #7 | 68.5 | 27.4 | 4.1 | | 10.8 | 18.6 | 0.68 | 0.72 | 0.59 |
| Sample $A_7$ | 22.7 | 26.0 | 2.6 | 48.7 | 5.5 | 13.0 | 0.76 | 0.81 | 0.65 |
| Sample $B_7$ Formula #8 | 69.4 | 27.8 | 2.8 | | 9.2 | 15.8 | 0.69 | 0.74 | 0.60 |
| Sample $A_8$ | 16.5 | 30.8 | 3.1 | 49.6 | 5.3 | 13.9 | 0.78 | 0.84 | 0.67 |
| Sample $B_8$ Formula #9 | 66.1 | 30.8 | 3.1 | | 11.2 | 21.9 | 0.70 | 0.77 | 0.57 |
| Sample $A_9$ | 48.3/0.00 | 20.6 | 2.1 | 29.0 | 7.2 | 13.2 | 0.93 | 0.96 | 0.78 |
| Sample $B_9$ Formula #10 | 48.3/29.0 | 20.6 | 2.1 | | 8.6 | 15.2 | 0.92 | 0.97 | 0.74 |
| Sample $A_{10}$ | 48.5 | 20.3 | 2.0 | 29.2 | 3.5 | 20.1 | 1.08 | 1.14 | 0.89 |
| Sample $B_{10}$ Formula #11 | 77.7 | 20.3 | 2.0 | | 4.9 | 23.9 | 1.06 | 1.13 | 0.84 |
| Sample $A_{11}$ | 50.8/0.00 | 15.4 | 1.5 | 32.3 | 6.0 | 11.8 | 0.71 | 0.76 | 0.63 |
| Sample $B_{11}$ Formula #12 | 50.8/32.3 | 15.4 | 1.5 | | 10.2 | 17.9 | 0.67 | 0.71 | 0.54 |
| Sample $A_{12}$ | 42.0 | 29.7 | 3.0 | 25.3 | 1.9 | 9.4 | 0.80 | 0.84 | 0.64 |
| Sample $B_{12}$ Formula #13 | 67.4 | 29.7 | 3.0 | | 8.3 | 17.6 | 0.72 | 0.77 | 0.58 |
| Sample $A_{13}$ | 41.9 | 29.9 | 3.0 | 25.2 | 4.0 | 16.5 | 0.86 | 0.88 | 0.69 |
| Sample $B_{13}$ | 67.1 | 29.9 | 3.0 | | 12.8 | 36.7 | 0.78 | 0.80 | 0.67 |

In Table 2, all of the $A_1$-$A_{13}$ samples were made according to the methods of the present invention. Samples $B_1$-$B_{13}$ were made in accordance with the methods of U.S. Pat. No. 3,769,222 to Yurko et al. The detergent composition of Formula #1 consisted of light ash builder, $C_{12}$-$C_{15}$ alcohol ethoxylates with an average of 7 moles of ethylene oxide per mole of alcohol nonionic surfactant, and hydrated amorphous silica barrier particles in the proportions indicated in Table 2. Formula #2 consisted of a mix of light ash and dense ash builders, $C_{12}$-$C_{15}$ alcohol ethoxylates with an average of 7 moles of ethylene oxide per mole of alcohol nonionic surfactant, and hydrated amorphous silica barrier particles in the proportions indicated. Sample $A_2$ incorporated all of the light ash in the first component, and all of the dense ash in the second component, whereas Sample $B_2$ incorporated a mix of both of those builders in a single addition. Formula #3 consisted of a mix of light ash and needle ash builders, $C_{12}$-$C_{15}$ alcohol ethoxylates with an average of 7 moles of ethylene oxide per mole of alcohol nonionic surfactant, and hydrated amorphous silica barrier particles in the proportions indicated. Sample $A_3$ incorporated all of the light ash in the first component, and all of the needle ash in the second component, whereas Sample $B_3$ incorporated a mix of both of those builders in a single addition. Formula #4 consisted of a mix of agglomerated zeolite builder, $C_{12}$-$C_{15}$ alcohol ethoxylates with an average of 7 moles of ethylene oxide per mole of alcohol nonionic surfactant, and hydrated amorphous silica barrier particles in the proportions indicated. Formula #5 consisted of light ash builder, $C_{12}$-$C_{15}$ alcohol ethoxylates with an average of 7 moles of ethylene oxide per mole of alcohol nonionic surfactant, and silicon dioxide, crystalline-free (fumed silica) barrier particles in the proportions indicated. Formula #6 consisted of light ash builder, $C_{12}$-$C_{15}$ alcohol ethoxylates with an average of 7 moles of ethylene oxide per mole of alcohol nonionic surfactant, synthetic amorphous silicon dioxide hydrate (agglomerated precipitated silica that was reduced in size to the particle sizes described herein) barrier particles in the proportions indicated. Formula #7 consisted of light ash builder, $C_{10}$-$C_{16}$ alcohol ethoxylates nonionic surfactant, and hydrated amorphous silica barrier particles in the proportions indicated. Formula #8 consisted of light ash builder, poly(oxy-1,2-ethanediyl), alpha-(nonylphenyl)-omega-hydroxy surfactant, and hydrated amorphous silica barrier particles in the proportions indicated. Formula #9 consisted of a mix of dense ash and needle ash builders, $C_{12}$-$C_{15}$ alcohol ethoxylates with an average of 7 moles of ethylene oxide per mole of alcohol nonionic surfactant, and hydrated amorphous silica barrier particles in the proportions indicated. Sample $A_9$ incorporated all of the dense ash in the first component and all of the needle ash in the second component, whereas Sample $B_9$ incorporated in a mix of both of those builders in a single addition. Formula #10 consisted of pentasodium triphosphate (or sodium tripolyphosphate) builder, $C_{12}$-$C_{15}$ alcohol ethoxylates with an average of 7 moles of ethylene oxide per mole of alcohol nonionic surfactant, and hydrated amorphous silica barrier particles in the proportions indicated. Formula #11 consisted of a mix of sodium nitrilotriacetate and light ash builders, $C_{12}$-$C_{15}$ alcohol ethoxylates with an average of 7 moles of ethylene oxide per mole of alcohol nonionic surfactant, and hydrated amorphous silica barrier particles in the proportions indicated. Sample $A_{11}$ incorporated all of the sodium nitrilotriacetate builder in the first component and all of the light ash builder in the second component. In contrast, Sample $B_{11}$ incorporated a mix of those two builders in a single addition. Formula #12 consisted of light ash builder, $C_{14}$-$C_{15}$ alcohol ethoxylates with an average of 12 moles of ethylene oxide per mole of alcohol nonionic surfactant, and hydrated amorphous silica barrier particles in the proportions indicated. Formula #13 consisted of light ash builder, $C_{14}$-$C_{15}$ alcohol ethoxylates with an average of 12 moles of ethylene oxide per mole of alcohol nonionic surfactant, and hydrated amorphous silica barrier particles in the proportions indicated.

The compositions of the present invention are preferably for use as a detergent intermediate or premix, or as a final detergent product, depending upon the choice and selection of additional optional ingredients. Although the present inventor envisages a wide array of potential uses or applications of the present invention, it is primarily directed toward the detergent industry and processes of making or producing detergents or various intermediates. The compositions to which the present invention may be applied to include detergent compositions for laundry and dish washing applications, car washes and related auto cleansing accessories, detergent add ins, and household general utility detergent formulations.

It is to be understood that while certain specific forms and examples of the present invention are illustrated and described herein, the invention is not to be limited to the specific examples noted here and above. Further, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A method for producing a powdered detergent composition comprising:

providing a first portion of a flowable powder detergent builder selected from the group consisting of sodium carbonate, sodium aluminum silicate, pentasodium triphosphate, trisodium nitrilotriacetate, citrates, sulfates and mixtures thereof;

blending said first portion of said flowable powder detergent builder with a liquid surfactant;

blending an effective amount of finely divided, water insoluble, silica barrier particles, with said blend of said first portion of detergent builder and said liquid surfactant to form a first component; and further blending said first component with a second portion of a flowable powder detergent builder selected from the group consisting of sodium carbonate, sodium aluminum silicate, pentasodium triphosphate, trisodium nitrilotriacetate, citrates, sulfates and mixtures thereof, wherein said first portion of said detergent builder comprises between about 10% to about 75% of the combined total of said first portion of said detergent builder and said second portion of said detergent builder, wherein the total of said first portion and said second portion of flowable powder detergent builder constitutes from about 40% to about 95% of the total of said first portion and said second portion of said flowable powder detergent builder, said finely divided barrier particles, and said liquid surfactant, and wherein said finely divided barrier particles constitute from about 0.5% to about 5% of the total of said first portion and said second portion of said flowable powder detergent builder, said finely divided barrier particles, and said liquid surfactant.

2. A method in accordance with claim 1 wherein said builder is sodium carbonate and is selected from the group consisting of light ash, dense ash and needle ash.

3. A method in accordance with claim 1 wherein said first portion of said builder comprises about 25% of the combined total of said first and second portions thereof.

4. A method in accordance with claim 1 wherein said liquid surfactant has a melting point in the range of from about 0° C. to about 65° C.

5. A method in accordance with claim 4 wherein said liquid surfactant is selected from the group consisting of anionic surfactants, cationic surfactants, nonionic surfactants, amphoteric surfactants, and mixtures thereof.

6. A method in accordance with claim 5 wherein said liquid surfactant is a nonionic surfactant.

7. A method in accordance with claim 6 wherein said nonionic surfactant is selected from the group consisting of alkanolamides, fatty amides, alkyl polyglycosides, amine oxides, alcohol alkoxylates, ethoxylated esters, sorbitan esters, glycerol esters, and combinations thereof.

8. A method in accordance with claim 6 wherein said nonionic surfactant is selected from the group consisting of a mixture of $C_{12}$-$C_{15}$ alcohol ethoxylates with an average of 7 moles of ethylene oxide per mole of alcohol, a mixture of $C_{10}$-$C_{16}$ alcohol ethoxylates, a mixture of $C_{14}$-$C_{15}$ alcohol ethoxylates with an average of 12 moles of ethylene oxide per mole of alcohol, an alkylphenol ethoxylate, and combinations thereof.

9. A method in accordance with claim 1 wherein said liquid surfactant constitutes from about 5% to about 50% of the total of said first portion and said second portion of said flowable powder detergent builder, said finely divided barrier particles, and said liquid surfactant.

10. A method in accordance with claim 1 wherein said finely divided barrier particles are hydrated amorphous silica.

11. A method in accordance with claim 1 wherein said finely divided barrier particles are silicon dioxide.

12. A method in accordance with claim 1 wherein said finely divided particles are crystalline-free silicon dioxide.

13. A method in accordance with claim 1 wherein said finely divided particles are synthetic amorphous silicon dioxide.

14. A method in accordance with claim 1 wherein said finely divided barrier particles have an average particle size of from about 0.5 microns to about 50 microns.

15. A method in accordance with claim 14 wherein said finely divided barrier particles are precipitated silica having an average ultimate particle size of from about 0.01 microns to about 0.025 microns and an average aggregate particle size of from about 1 micron to about 10 microns.

16. A method in accordance with claim 14 wherein said finely divided barrier particles are fumed silica having an average ultimate particle size of from about 0.001 microns to about 0.1 microns and an average aggregate particle size of from about 2 microns to about 3 microns.

* * * * *